US007707922B1

(12) United States Patent
Dekel

(10) Patent No.: US 7,707,922 B1
(45) Date of Patent: May 4, 2010

(54) MOBILE CARRIER FOR A PROJECTILE LAUNCHER

(75) Inventor: Ehud Dekel, Nofit (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 387 days.

(21) Appl. No.: 11/475,380

(22) Filed: Jun. 27, 2006

(30) Foreign Application Priority Data

Jun. 30, 2005 (IL) ..... 169481

(51) Int. Cl.
*F41F 3/042* (2006.01)

(52) U.S. Cl. ..... 89/1.815; 89/1.806

(58) Field of Classification Search ..... 89/1.806, 89/1.815, 37.05, 37.13, 40.02, 40.11, 36.01, 89/36.02, 36.03, 36.04, 36.07, 36.08, 36.09, 89/36.12, 36.17
See application file for complete search history.

(56) References Cited

U.S. PATENT DOCUMENTS

| | | | | | |
|---|---|---|---|---|---|
| 2,568,455 | A | | 9/1951 | Lindvall et al. | 89/1.819 |
| 2,993,413 | A | * | 7/1961 | McCormack | 89/1.815 |
| 3,048,087 | A | * | 8/1962 | Campbell | 89/1.802 |
| 3,340,768 | A | * | 9/1967 | Kindrot et al. | 89/1.815 |
| 3,379,097 | A | * | 4/1968 | Fisher | 89/1.816 |
| 3,786,715 | A | * | 1/1974 | Even | 89/1.805 |
| 3,832,932 | A | * | 9/1974 | Even et al. | 89/40.11 |
| 4,282,794 | A | * | 8/1981 | Miller et al. | 89/36.15 |
| 4,573,396 | A | * | 3/1986 | Streetman et al. | 89/36.08 |
| 5,461,961 | A | * | 10/1995 | Baus et al. | 89/1.815 |
| 5,682,005 | A | * | 10/1997 | Crowley | 89/1.815 |
| 6,584,881 | B1 | * | 7/2003 | Boudreau et al. | 89/1.804 |
| 6,691,600 | B2 | * | 2/2004 | Boudreau et al. | 89/1.815 |
| 7,418,897 | B2 | * | 9/2008 | Balbo | 89/40.02 |
| 2006/0266208 | A1 | * | 11/2006 | Jean-Francois et al. | 89/37.13 |

FOREIGN PATENT DOCUMENTS

| | | |
|---|---|---|
| DE | 4014192 | 11/1991 |
| EP | 1400773 | 3/2004 |
| EP | 1500899 | 1/2005 |
| FR | 1445111 | 7/1966 |
| WO | WO 03/025494 | 3/2003 |

* cited by examiner

*Primary Examiner*—Bret Hayes
(74) *Attorney, Agent, or Firm*—Ohlandt, Greeley, Ruggiero & Perle, L.L.P.

(57) ABSTRACT

A mobile projectile launcher is disclosed having a tiltable launching platform for supporting a plurality of canisters in each of which projectiles to be launched are stored and fired, a support plate pivotally connected to a horizontal cargo bed, and at least one linear actuator by which the support plate is swingable from a closed position substantially perpendicular to the cargo bed to an open position substantially parallel to the cargo bed. The support plate is made of a material that is resistant to the projectile plume following launching and is sufficiently sturdy to support a technician during the loading of projectiles when set in an open position, yet is adapted to protect and hide the loaded canisters when set in a closed position.

13 Claims, 10 Drawing Sheets

MOBILE CARRIER FOR A PROJECTILE LAUNCHER

FIELD OF THE INVENTION

This invention refers to a projectile launcher, such as for launching rockets and missiles, which is provided with a support plate by which protection for the projectiles is provided, access to the projectiles is facilitated, and streams of hot gases generated in the launching are deflected.

BACKGROUND OF THE INVENTION

Rocket launchers are mounted for transport in different ways, for instance on tracked carriers, trucks or on trailers that may be attached or detached from vehicles. In certain cases the direction of firing is parallel to the direction of travel of the vehicle. In other cases, the direction of firing is perpendicular to the direction of travel of the carrier. The term "front" and "rear" will be used in this specification and claims as defined with respect to the direction of firing, irrespective of whether said direction is parallel or perpendicular to the direction of travel of the carrier or vehicle.

In the prior art, the canisters in which rockets are contained prior to being launched are generally exposed. Military personnel mechanically couple the canisters to a launcher, electronically connect the launcher to the rockets during launching and trial studies, and load the rockets within the canisters. Military personnel need also to carry out required maintenance of the canisters and launchers, as well as other types of preparation, prior to the launching of the rockets. Since the canisters occupy the whole width of the vehicle, which is limited by mobility requirements, operators have to stand on neighboring canisters or on the ground, while carrying out these tasks, usually in an inconvenient and/or unsafe position.

Prior art carriers for a rocket launcher also suffer from other drawbacks. Firstly, when the rockets are fired, streams of hot gases are discharged from the unobstructed rear of the canister and impact the ground, possibly igniting a fire in surrounding brush or other combustible matter, particularly if many rockets are fired at short intervals. Also, the impact of the plume onto the ground raises dust and even small stones, which are harmful to the personnel and to the launcher equipment, and which also expose the location of the launcher to the enemy during firing. Secondly, are exposed when the canisters are transported, and are therefore susceptible to bomb fragments, exposure to enemy observation, or even to terrorist activities.

It is an object of the present invention to overcome said drawbacks of prior art rocket launcher carriers.

It is an object of the present invention to provide a rocket launcher carrier which shields and hides the rockets during transportation.

It is another object of the present invention to provide a rocket launcher carrier which prevents the rocket plume from impacting the surrounding ground, so as to avoid ignition of combustible matter or to avoid detection during launching.

It is a further object of the present invention to provide a rocket launcher which facilitates the access of personnel to the canisters when desired.

It is a further object of the present invention to provide a rocket launcher of limited width, to simplify transportation and to increase the number of possible locations from which rockets may be launched.

It is yet a further object of the present invention to provide a rocket launcher carrier which allows for military personnel to work conveniently and safely during the loading, connection and maintenance of canisters.

Other purposes and advantages of the invention will appear as the description proceeds.

SUMMARY OF THE INVENTION

The present invention relates to a mobile projectile launcher, which comprises: (a) a plurality of canisters in each of which projectiles to be launched are stored and fired; (b) a horizontal cargo bed; (c) at least one tiltable launching platform for supporting said plurality of canisters; (d) at least one support plate which is pivotally connected to said cargo bed, said at least one support plate being made of a material which is resistant to the projectile plume following launching and sufficiently sturdy to support a person standing thereon; and (e) at least one linear actuator for each of said plates by which said at least one support plate is swingable from a closed position wherein said at least one support plate is substantially perpendicular to said cargo bed to an open position wherein said at least one support plate is substantially parallel to said cargo bed.

Preferably, each linear actuator comprises a housing and a linearly extendable rod.

Preferably, the inclination of a support plate changes with respect to the cargo bed as a linearly extendable rod is extended.

Preferably, each actuator is of the hydraulic, pneumatic, or electric type.

Preferably, the housing is pivotally connected to a first lug which is connected to a side wall vertically protruding from the cargo bed.

Preferably, the extendable rod is pivotally connected to a second lug which is attached to a corresponding support plate.

Preferably, the first lug is attached to a member attached to said side wall. Preferably, the at least one support plate is lockable in its closed position. Preferably, the at least one support plate is lockable in its open position.

Preferably, the at least one support plate in an open position is suitable for deflecting the projectile plume.

Preferably, at least one supporting plate is pivotally connected to the cargo bed at the rear of the plurality of canisters.

Preferably, at least one support plate is also pivotally connected to the cargo bed in front of the plurality of canisters.

Preferably, the carrier of the invention further comprises tilting mechanism for adjusting the inclination of the tiltable platforms supporting the plurality of canisters with respect to the cargo bed.

BRIEF DESCRIPTION OF THE DRAWINGS

In the drawings:

in FIG. 6 the launcher is ready for launching, the canisters are tilted and the support plate is in its horizontal position; in FIG. 7 the launcher is ready to move, the canisters tilting mechanism is depressed and the support plate is in its vertical position;

DETAILED DESCRIPTION OF PREFERRED EMBODIMENTS

The present invention is a novel projectile launcher carrier provided with an integral pivotable support plate for supporting technicians during the loading of projectiles and for deflecting the projectile plume following launching when set in an open position, yet which protects and hides the loaded canisters when set in a closed position.

FIGS. 1-5 illustrate prior art projectile launcher carriers. The carrier of FIG. 1 travels in the direction of launching, and a plurality of launch tubes are shown to be tilted at an inclination suitable for launching. The carrier of FIG. 2 transports projectile canisters in a horizontal disposition, two of which being carried by a towed, wheeled unit. The carrier of FIG. 4 transports projectile canisters by means of chain treads. It may be seen that although the canisters are shielded from the sides and top, their aft is exposed, and rocket plume is free to hit the ground. The transported projectiles are exposed to enemy observation, bomb fragments or even to terrorist activities.

Figure 1:
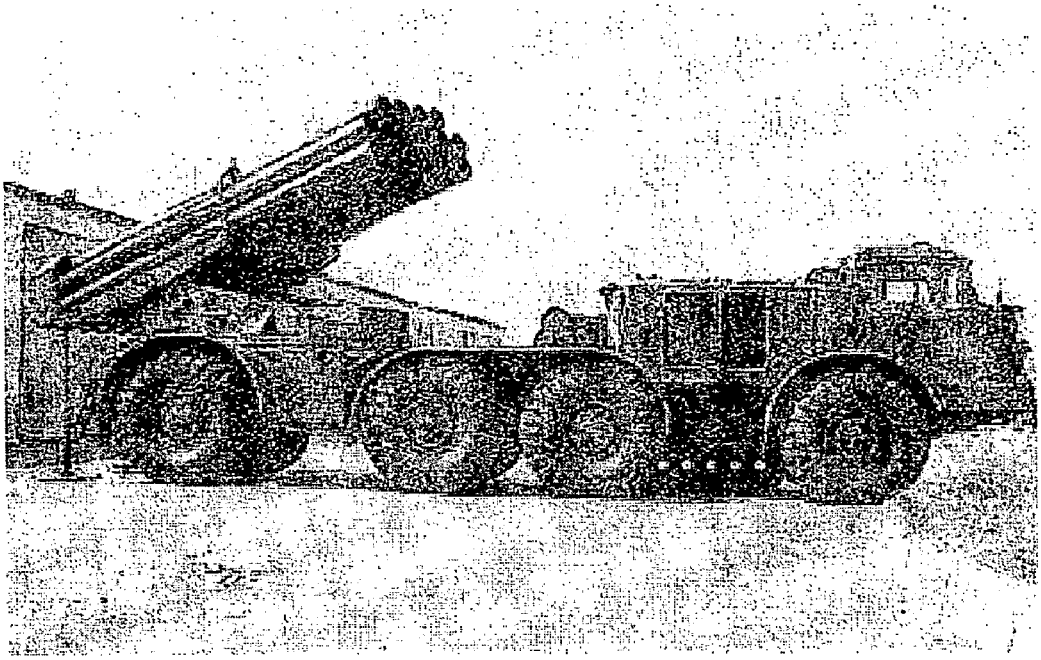
Fig. 1 PRIOR ART
FIGS. 1-5 are photographs of prior art projectile carriers.
Figure 2:
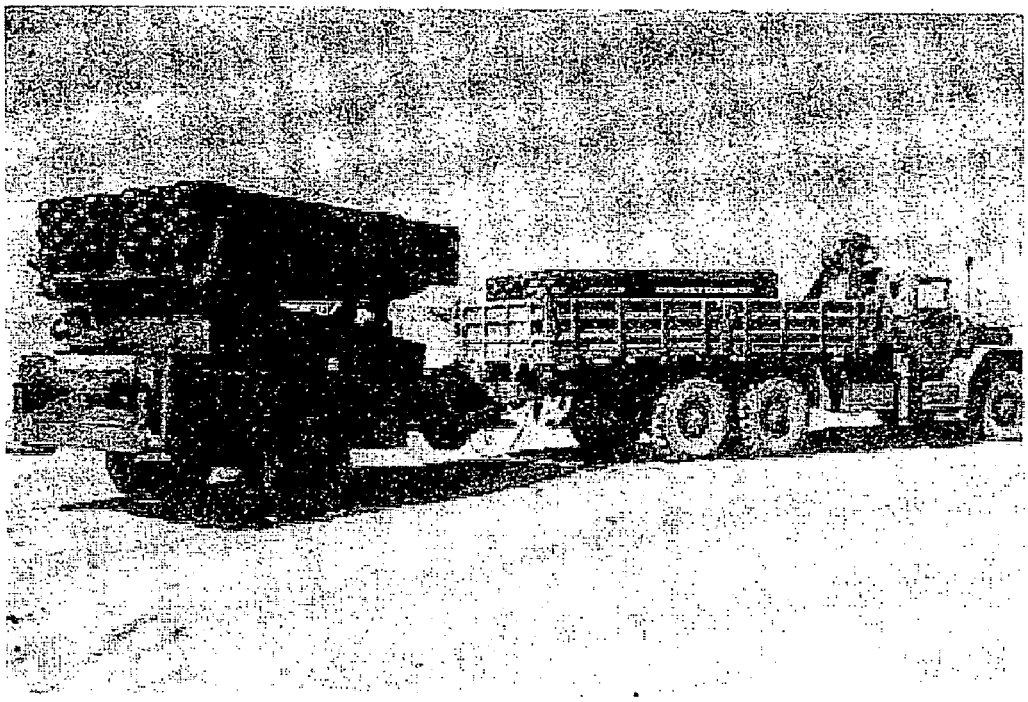
Fig. 2 PRIOR ART
Figure 3:
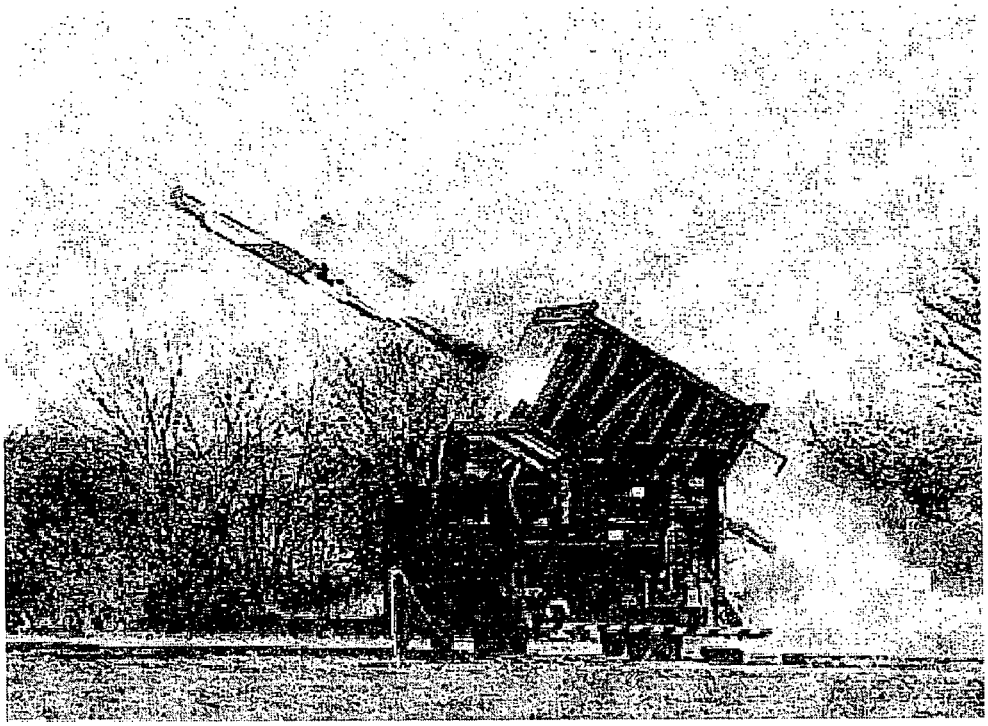
Fig. 3 PRIOR ART
Figure 4:
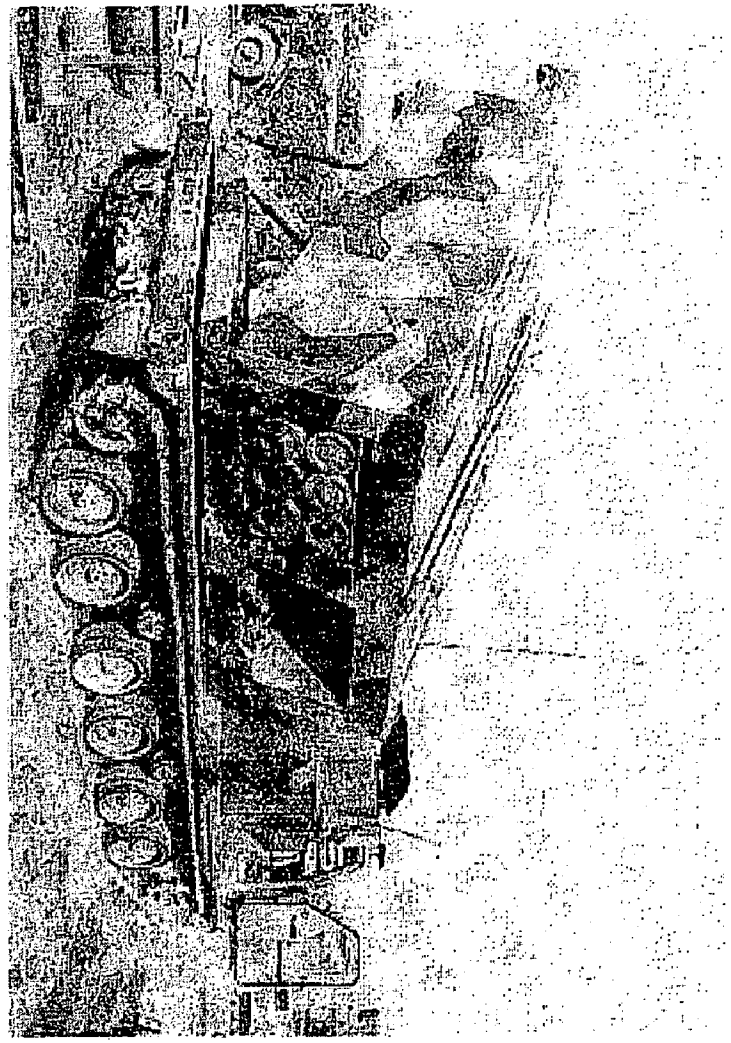
Fig. 4 PRIOR ART
Figure 5:
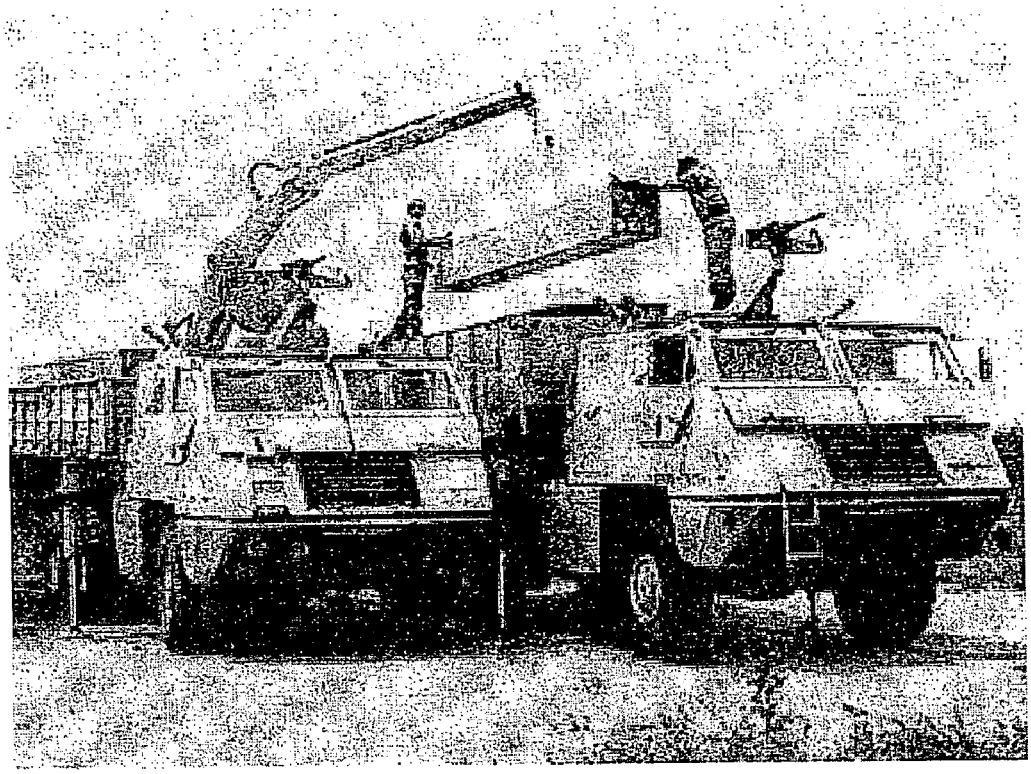
Fig. 5 PRIOR ART

Military personnel are shown in FIG. 5 to unload projectile canisters onto a carrier platform, to which the canisters are subsequently attached prior to launching. It may be seen that they have to stand unsafely on neighboring canisters because there is no working platform on the vehicle. A projectile is shown to be fired from the carrier of FIG. 3, along a predetermined inclination with respect to the ground. The plume exits the rear of the canister and is liable to ignite the trees or brush in the vicinity of the launcher, thereby risking exposure by the enemy and causing damage to the surroundings.

In the embodiments to be described, it will be assumed that a projectile launcher is mounted on a carrier of any kind which travels perpendicularly to the directions of launching. This is done for purposes of description and does not constitute a limitation in any way, as what will be described would continue to apply if the carrier were traveling in the direction of launching.

Figure 6:
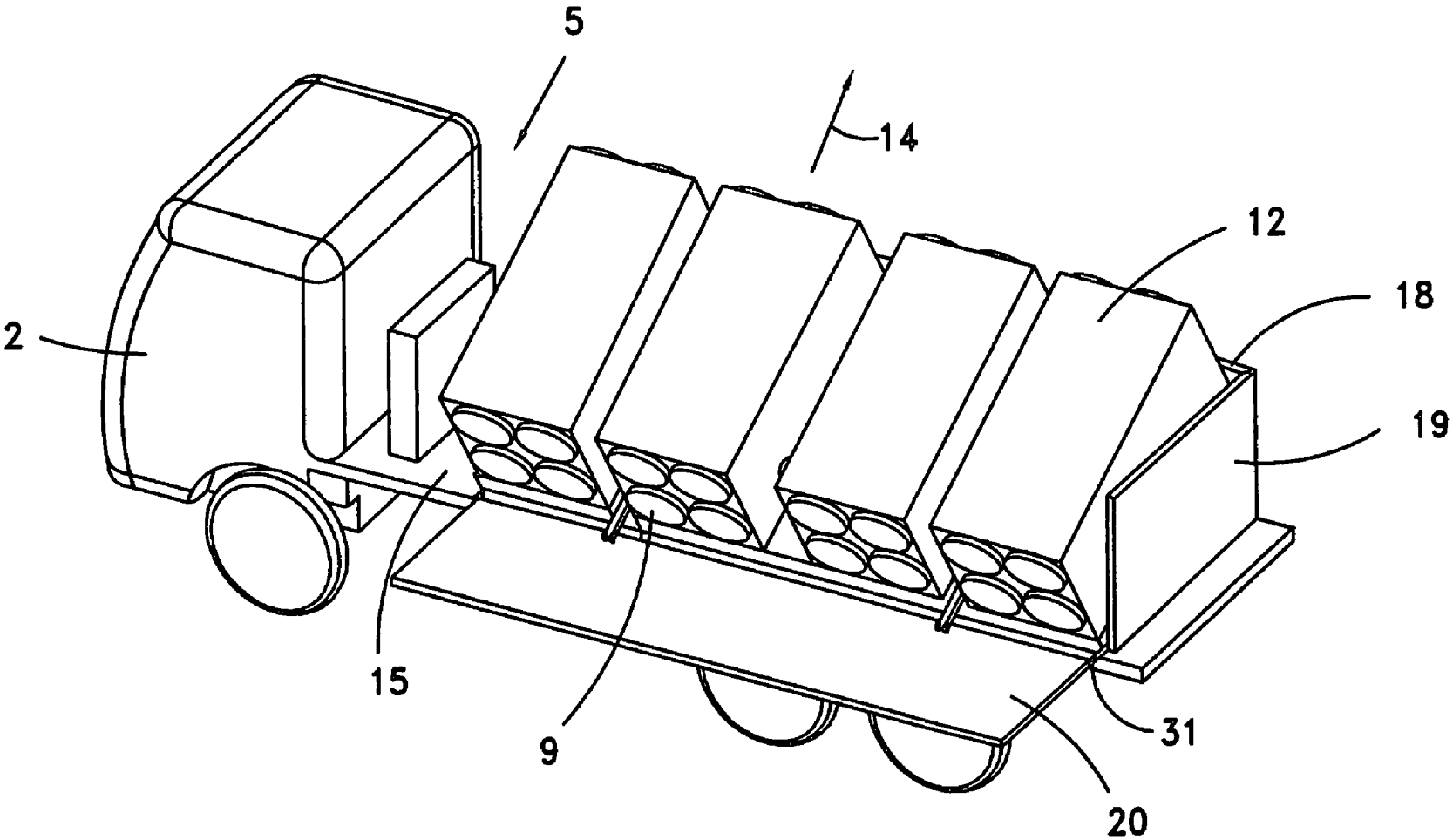
FIGS. 6 and 7 illustrate a perspective view of a carrier for a projectile launcher according to one embodiment of the invention.

FIG. 6 illustrates an exemplary mobile rocket or missile launcher which is generally designated by numeral 5, Mobile launcher 5 comprises driver cabin 2, a cargo bed 15, tiltable platform (not indicated) supporting a plurality of canisters 12, and front wall 18 and side walls 19 for protecting and hiding the plurality of canisters 12. The mobile launcher comprises conventional means (not shown) for tilting canisters 12 from a horizontal disposition which is the orientation during transportation, to an inclination with respect to the ground which is suitable for launching. The launcher also comprises conventional means for launching a projectile 9 (not shown), including electronic equipment and cables connected to the canisters, in the direction of launching indicated by arrow 14. The orientation of wheels 10 indicate that carrier 5 moves perpendicularly to the direction of launching.

Figure 7:
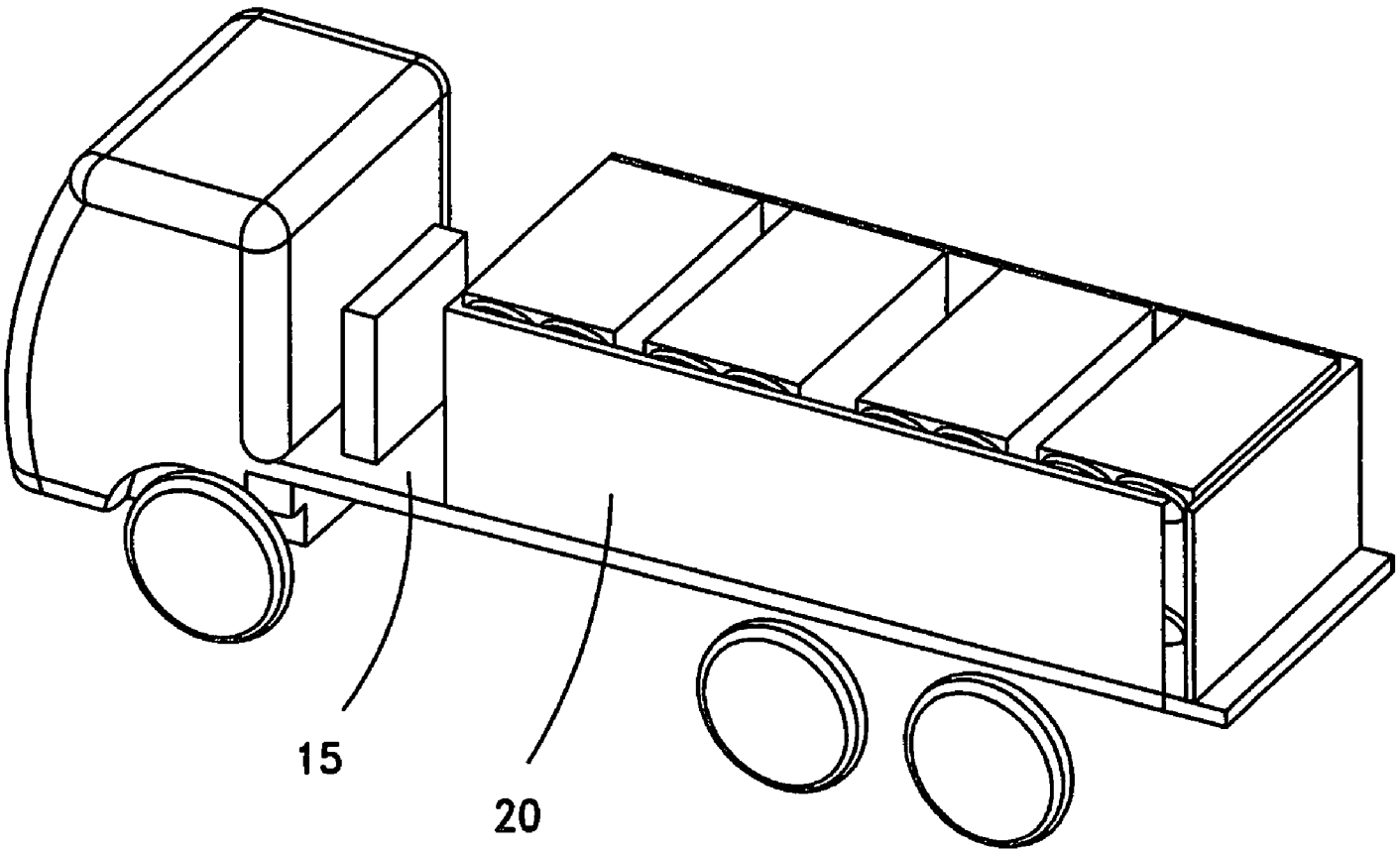

In accordance with the present invention, mobile launcher 5 further comprises a single support plate 20, which is in pivotal connection with the cargo bed. Support plate 20 has two functional positions. A first position (hereinafter an "open position") is illustrated in FIG. 6, whereat support plate 20 is substantially horizontal, being substantially parallel to the cargo bed. A second position (hereinafter a "closed position") is illustrated in FIG. 7, whereat support plate 20 is substantially perpendicular to the cargo bed. When in a closed upright position, support plate 20 contacts side walls 19, whereby to protect and hide the canisters. Consequently, the projectiles are transported in a horizontal disposition, are concealed by upright plate 20, and are shielded and hidden. Support plate 20, in addition to its pivotal connection, is sturdy enough to support military personnel standing thereon.

The support plate 20 is made of a suitable type of materials well known to those skilled in the art, that are resistant to the high temperature of the projectile plume following launching, and therefore serves as a plume deflector, thereby preventing the ignition of combustible matter and avoiding detection of the launcher during launching.

Figure 8:
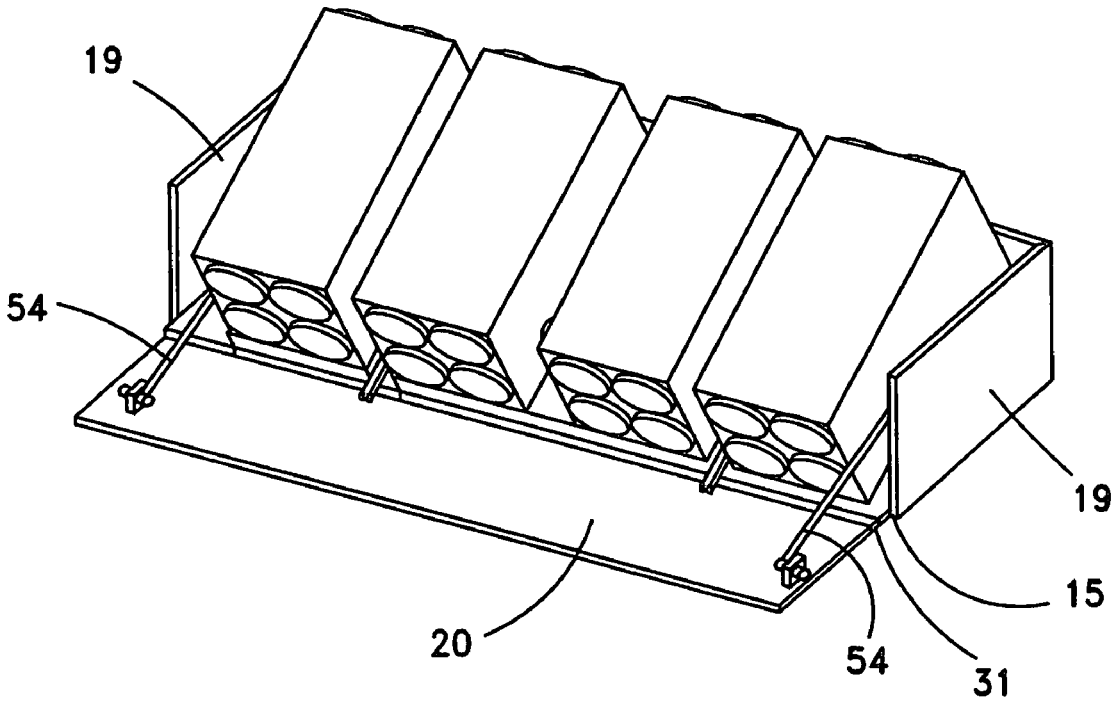
FIG. 8 illustrates a perspective view of a support plate which is held open by means of two linear actuators.
Figure 9A:
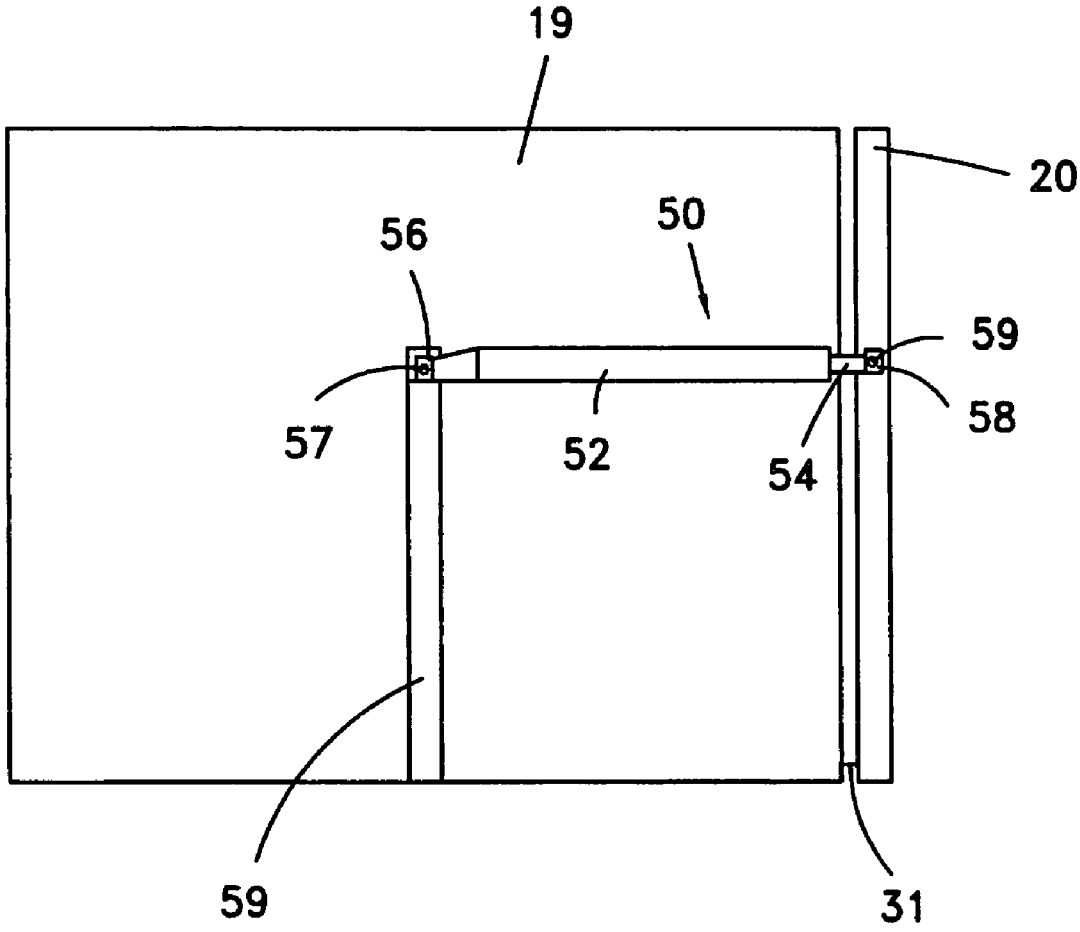
FIGS. 9A and 9B illustrate a side view of a linear actuator pivotally connected to a support plate in retracted and fully extended positions, respectively.
Figure 9B:
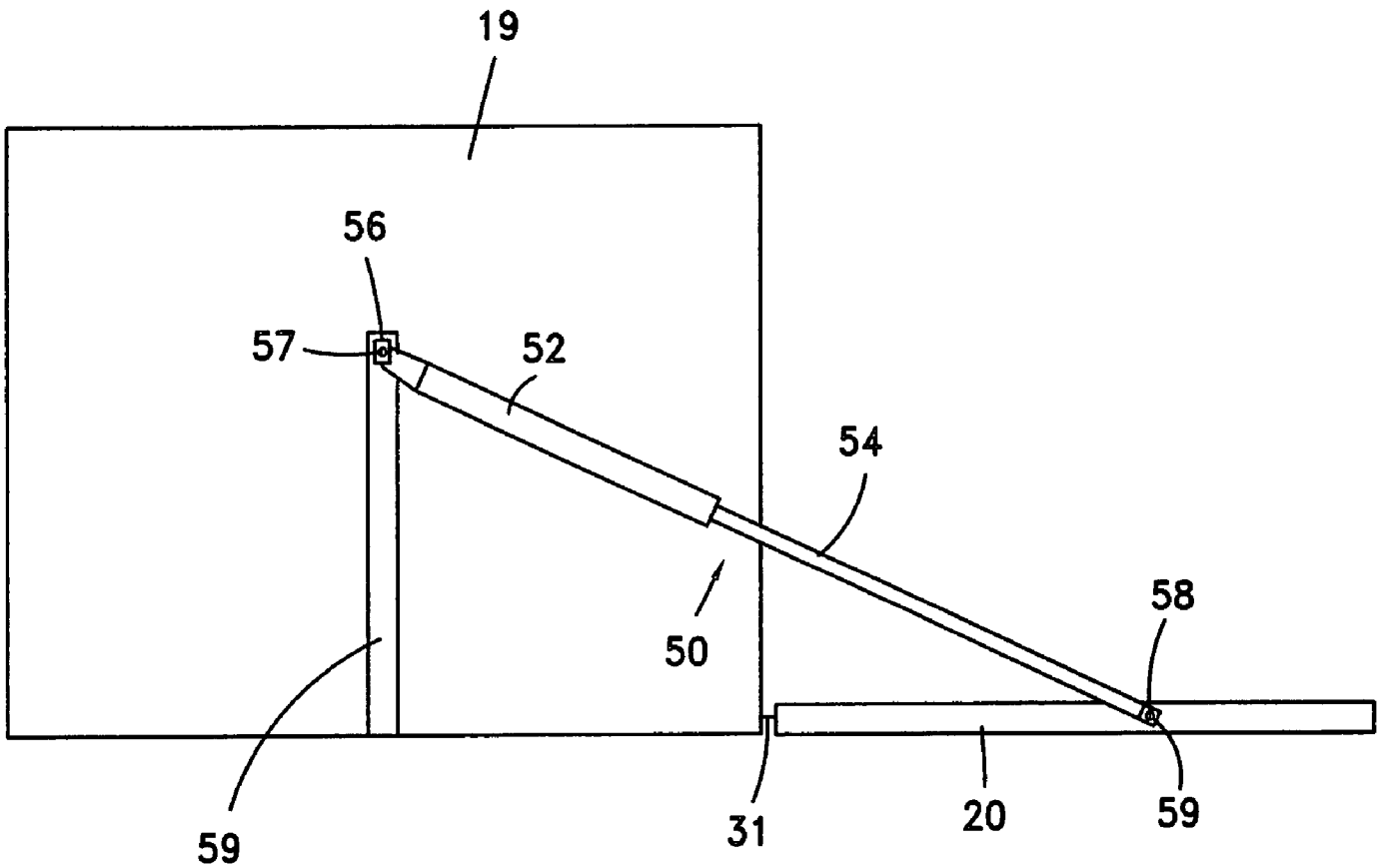

With reference to FIGS. 8, 9A and 9B, support plate 20 is pivotable by means of two linear actuators 50. FIG. 8 illustrates a perspective view of two extended actuators, which retain support plate in a closed position.

FIG. 9A is a side view of support plate 20 and a front view of a linear actuator in a retracted position. FIG. 9B is a side view of support plate 20 and a front view of a linear actuator in an extended position.

Each linear actuator 50, which may be of the hydraulic, pneumatic, or electric type, comprises a housing 52 and a rod 54 which linearly extends from housing 52. Cylinder 52 is pivotally connected by means of pin joint 57 to lug 56, which in turn is attached to pillar 59 attached to side wall 19, or alternatively attached directly to side wall 19. Extendable rod 54 is pivotally connected by means of pin joint 59 to lug 58, which in turn is attached to support plate 20. When support plate 20 is in a closed position as shown in FIG. 9A, extendable rod 54 is as its most retracted position. As rod 54 is extended, a force is applied to support plate 20, causing the latter to change its inclination with respect to cargo bed 15. Extendable rod 54 then pivots about pin joint 59, causing cylinder 52 to pivot about pin joint 57. As rod 54 continuously extends its length and pivots, the inclination of support plate 20 continues to change with respect to cargo bed 15 until achieving a completely open and horizontal position as shown in FIG. 9B. The illustrated open position of support plate 20 corresponds to the maximum extension of rod 54. When rod 54 is retracted to its minimal extent, it is locked in place by conventional means well known to those skilled in the art to prevent support plate 20 against unwanted opening.

It will be appreciated that any other type of linear actuator may be employed, as well known to those skilled in the art. It will also be appreciated that one linear actuator may be employed instead of two, and may be positioned at the center of support plate 20. Similarly, instead of one support plate 20 being employed as shown, two support plates may be in use, each of which being separately pivoted by means of a corresponding linear actuator 50. Likewise additional pivotable plates may also be deployed at other sides of the canisters.

The advantages of the invented apparatus appear clearly from the description. It should be noted that the supporting plate will generally be a heavy metal piece, preferably made of steel, weighing on the order of hundreds of kilograms, so that at least one linear actuator is needed to pivot the supporting plate from the open to closed position, or vice versa. The supporting plate provides a support which permits easy access to the electrical elements required for launching the projectiles, easy loading and unloading of the canisters by means of a raising or lowering mechanism, and easy access to the firing control and the electrical control. The opened plate prevents the ignition of combustible material during a launch, the creation of dust clouds, and the projection of rocks when a large number of projectiles are fired in a short time. The activation of linear actuator 50 to extend rod 54 permits a rapid preparation to the firing of a projectile. The activation of linear actuator 50 to retract rod 54 permits a rapid preparation to departure from the firing site. Plate 20 is locked in a closed or open position, to prevent serious damage or bodily injury. When the plate is open, there is full visibility of the projectile canisters and the control equipment needed for launching, in general, and in particular from the direction of the driver cabin.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A mobile projectile launcher, comprising:

a) a plurality of canisters in each of which projectiles to be launched are stored and fired;

b) a horizontal cargo bed;

c) a front wall, rear wall, and side walls extending vertically from said cargo bed and delimiting a volume in which said plurality of canisters are disposed;

d) at least one tiltable launching platform for supporting said plurality of canisters;

e) at least one support plate selected from the group of said front wall, rear wall and side walls which is pivotally connected to said cargo bed, said at least one support plate being made of a material which is resistant to projectile plume following launching and sufficiently sturdy to support a person standing thereon; and f) at least one linear actuator for said at least one support plate by which said at least one support plate is swingable from a closed position, wherein said at least one support plate is substantially perpendicular to said cargo bed to an open horizontal position wherein said at least one support plate is substantially parallel to said cargo bed, wherein the at least one linear actuator comprises a housing and a linearly extendable rod, wherein said at least one support plate protects, shields and conceals loaded canisters when set in a closed position, supports a person during loading or unloading of canisters, during a maintenance operation and when accessing a control system of said launcher, and deflects projectile plume when set in an open position.

2. The launcher according to claim 1, wherein the inclination of the at least one support plate changes with respect to the cargo bed as the linearly extendable rod is extended.

3. The launcher according to claim 1, wherein the at least one actuator is a hydraulic, pneumatic, or electric actuator.

4. The launcher according to claim 1, wherein the housing is pivotally connected to a first lug which is connected to a side wall vertically protruding from the cargo bed.

5. The launcher according to claim 4, wherein the linearly extendable rod is pivotally connected to a second lug which is attached to a corresponding support plate.

6. The launcher according to claim 4, wherein the first lug is attached to a member attached to said side wall.

7. The launcher according to claim 1, wherein the at least one support plate is lockable in its closed position.

8. The launcher according to claim 1, wherein the at least one support plate is lockable in its open position.

9. The launcher according to claim 1, wherein the at least one support plate is pivotally connected to the cargo bed at the rear of the plurality of canisters.

10. The launcher according to claim 1, wherein the front wall comprises at least one support plate which is pivotally connected to the cargo bed in front of the plurality of canisters.

11. The launcher according to claim 1, further comprising a tilting mechanism for adjusting the inclination of the at least one tiltable launching platform supporting the plurality of canisters with respect to the cargo bed.

12. The launcher according to claim 1, wherein the at least one linear actuator is adapted to swing the at least one support plate from an open position to a closed position.

13. The launcher according to claim 1, wherein the at least one support plate is substantially perpendicular to, and substantially in contact with, one or two adjacent walls selected from the front wall, rear wall, and side walls.

* * * * *